United States Patent [19]

Summers

[11] 4,106,577

[45] Aug. 15, 1978

[54] HYDROMECHANICAL DRILLING DEVICE

[75] Inventor: David A. Summers, Rolla, Mo.

[73] Assignee: The Curators of the University of Missouri, Columbia, Mo.

[21] Appl. No.: 808,161

[22] Filed: Jun. 20, 1977

[51] Int. Cl.[2] ..... E21C 15/00

[52] U.S. Cl. ..... 175/340; 175/67; 175/393

[58] Field of Search ..... 175/67, 339, 340, 393, 175/422; 239/548, 561; 299/17

[56] References Cited

U.S. PATENT DOCUMENTS

| | | | |
|---|---|---|---|
| 2,218,130 | 10/1940 | Court | 175/422 X |
| 2,755,071 | 7/1956 | Kammerer, Jr. | 175/340 X |
| 2,785,875 | 3/1957 | Hayes | 175/67 X |
| 2,963,102 | 12/1960 | Smith | 175/340 X |
| 3,016,099 | 1/1962 | Woodruff | 175/340 X |
| 3,070,182 | 12/1962 | Runte | 175/339 |
| 3,081,828 | 3/1963 | Quick | 175/67 |
| 3,455,515 | 7/1969 | Connolly | 175/67 X |
| 3,865,202 | 2/1975 | Takahashi et al. | 175/67 X |

FOREIGN PATENT DOCUMENTS

| | | | |
|---|---|---|---|
| 1,484,520 | 9/1969 | Fed. Rep. of Germany | 175/67 |
| 1,104,310 | 2/1968 | United Kingdom | 175/340 |

OTHER PUBLICATIONS

Novel Drilling Techniques, W. C. Maurer, Pergamon Press NY, Mar. 1968, pp. 39–44.

*Primary Examiner*—Stephen J. Novosad
*Assistant Examiner*—Richard E. Favreau
*Attorney, Agent, or Firm*—Ray E. Snyder

[57] ABSTRACT

A hydromechanical drilling tool which combines a high pressure water jet drill with a conventional roller cone type of drilling bit. The high pressure jet serves as a tap drill for cutting a relatively small diameter hole in advance of the conventional bit. Auxiliary laterally projecting jets also serve to partially cut rock and to remove debris from in front of the bit teeth thereby reducing significantly the thrust loading for driving the bit.

1 Claim, 2 Drawing Figures

HYDROMECHANICAL DRILLING DEVICE

BACKGROUND OF THE INVENTION

The invention described herein was made in part in the course of work under a grant or award from the United States Energy Research and Development Administration.

FIELD OF THE INVENTION

This invention relates generally to the field of Boring or Penetrating the Earth, and more particularly to apparatus for boring by the combined actions of fluid erosion and mechanical roller cone drilling.

DESCRIPTION OF THE PRIOR ART

Roller cone types of drill bits are well known in the are for drilling oil wells and for numerous other drilling applications. Such drill bits normally comprise a cylindrical column which has mounted on its lower end a plurality of conical rollers formed with hardened cutting teeth or with raised bosses of tungsten-carbide. The drill bit is most commonly oriented along a vertical axis and is rotated as it is lowered to penetrate the earth. The hardened teeth cut away the rock and other material as the drill advances and the debris is carried away by a drilling mud. In drilling through hard rock, the rock fragments are physically ground away by the bit teeth and advance is very slow.

In our earlier application entitled, Method and Apparatus for Water Jet Drilling of Rock, Ser. No. 763,926, filed Jan. 31, 1977, there was described a water jet drill capable of drilling relatively small diameter holes, but at very high advance rates — up to 300 inches per minute in sandstone. The holes so drilled were generally not of a uniform diameter and consequently not ideally suited for pipe casings. In practice, such a high rate of advance is greater than the practicable speed at which pipe can be fed into the hole. An advance rate of approximately 60 inches per minute (300 feet per hour) appears to be a feasible maximum.

The water jet drill alone was found to work extremely well in sedimentary rock, in part perhaps because the infusion of the rock ahead of the nozzle by the axial jet weakens it sufficiently that the reaming jet is able to cut more effectively. Such is not the case in crystaline material. In harder material, such as granite, the granular material is removed on a grain by grain basis and the jet cutting action is extremely localized under the impact point. The presence of the grain boundaries serves to arrest any cracks which initiate in and around the cutting location, and for this reason the jet will cut very narrow slots not much wider than the jet diameter itself and thus must be taken into account when relating advance rate and rotational speed. The reason for this is that the jet which reams the hole will only cut the jet diameter each revolution; and where the advance rate is greater than the jet diameter per revolution, the hole will no longer become smooth but rather ribs will be created on the sides of the hole which will eventually work towards the center interfering with the passage of the drilling bit. Where these ribs are small they can easily be broken by the main jet assembly but this causes abrasion of the drilling tool when no mechanical cutter is incorporated in the system and provides a limit to the jet performance. Where the feed rate is less than the jet diameter there is a noticeable increase in hole diameter.

SUMMARY OF THE INVENTION

The present invention is a combination of a conventional roller cone type of drill bit and a high pressure water jet drill oriented along the central axis of the drill. The jet drill has an axially directed stream and an angularly directed reaming stream disposed at an angle of approximately 30° from the axial stream. In addition, a plurality of radially projecting streams are provided which assist the roller cone teeth in cutting away rock in the immediate proximity of the teeth and in clearing away debris from the vicinity of the teeth thereby allowing a significant reduction in the vertical thrust acting on the drill bit.

The water jet drill is rotated as it advances so as to produce a generally cylindrical hole in advance of the larger diameter hole formed by the roller cones. Such rotation of the water jet drill is coincident with the axial rotation of the roller cone bit, and the radial jets impinge at the point of contact of the roller cone teeth with the rock.

DETAILED DESCRIPTION OF THE PREFERRED EMBODIMENT

Figure 1:
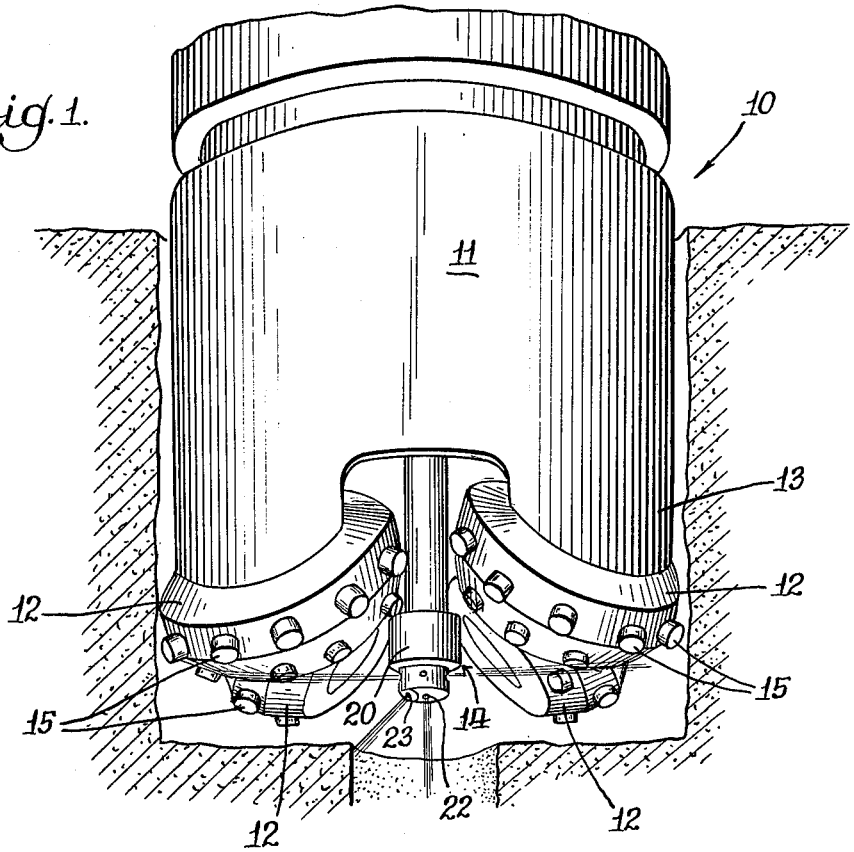
FIG. 1 is a schematic side elevation view of the combined drilling tool of the present invention.

The improved hydromechanical drilling tool is illustrated in FIG. 1 and is designated generally by the numeral 10. The tool 10 comprises a generally cylindrical body 11, a plurality or cluster of roller cones 12 attached to the lower end 13 of the body 11, and an axial high pressure water jet drill 14 disposed within the cluster of cones 12. The cones 12 have formed on their exterior a plurality of cutting teeth or bosses 15. The teeth 15 preferably are made of tungsten-carbide. The tool 10 is adapted to be connected to and driven by a conventional drilling rig (not shown). The jet drill 14 is adapted to be rotated about the drilling axis along the cluster of cones 12 and is connected to a high pressure water source (not shown). The pressure for operating the jet drill is normally of a magnitude of 10,000 psi or greater.

Figure 2:
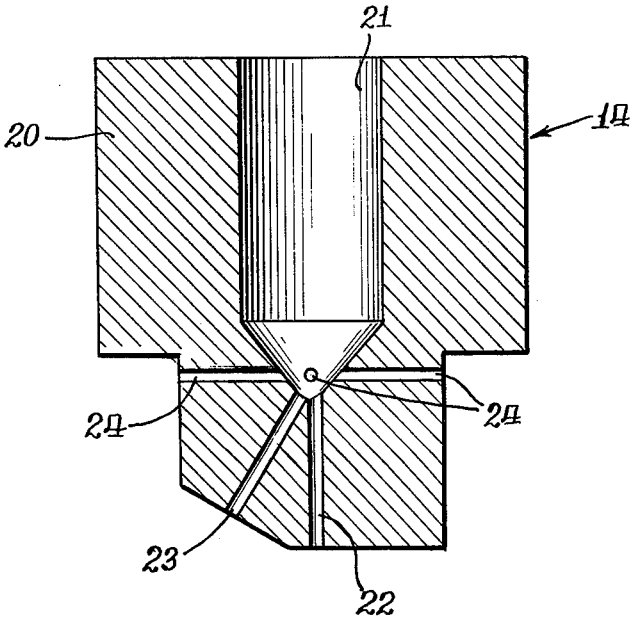
FIG. 2 is an enlarged longitudinal sectional view of the water jet drilling nozzle.

Referring to FIG. 2, the jet drill 14 is seen to comprise a generally cylindrical body 20 formed with an axial central bore 21, an axial jet 22, an angularly disposed reaming jet 23, and a plurality of radial jets 24, all opening into the central bore 21.

The ratio of the diameters of the reaming jet 23 and of the central axial jet 22 is approximately 2:1 as was described in our earlier application Ser. No. 763,926. The diameters of the radial jets 24 are of the same order of magnitude as that of the central jet 22. One radial jet 24 is provided for each roller cone 12 and is aimed precisely at the point of contact between the teeth 15 and the rock.

In operation, the water jet drill 14 drills a small diameter access hole along the axis of the drill 10. The roller cones 12 then ream this hole to the diameter of the drill bit 10. The roller cones 12 operating alone would suffer from the creation of plastic zones under the teeth 15 with a consequent reduction in the effective penetration rate. However, the radial jets 24 direct streams along the contact line between the drilling bit and the rock surface. Thus, as the rock is crushed under the cones 12 the debris is immediately removed by the high pressure radial jets. This has been found to reduce significantly the load on the cones 12 for a given penetration rate while at the same time increasing the penetration ability of the tool 10 itself. Some initial experiments on Indiana limestone have been conducted to determine baseload conditions for the system and to provide some initial parameters for evaluation. The results of these experiments are set forth in Table I below.

TABLE I

Effects on drill bit load where jet assist is applied to a 3 ¾" diameter coring bit.

| Advance Rate | Without assist rpm | | | With assist | | | | |
|---|---|---|---|---|---|---|---|---|
| (0.001 | 58 | 91 | 136 | 58 | 91 | 136 | 342 | 536 |
| in./rpm) | Applied Load on Bit (lb) | | | | | | | |
| 5.5 | 550 | 600 | 650 | 400 | 500 | 450 | 750 | 600 |
| 11. | 1175 | 1100 | 850 | 750 | 750 | 750 | — | 1000 |
| 17. | 1400 | 1250 | 1500 | 1000 | 900 | 1150 | — | 1100 |
| 20. | — | — | — | — | — | — | — | 1650 |

Preliminary conclusions from this series of tests are that using the water jet reduces the force required to cut the rock while at the same time allowing greater advance rates to be achieved than could be achieved without jet assistance.

Crystalline rock in general does not have the large number of voids and the high permeability of the sandstone used in prior experiments. Consequently, it has been found that the use of the jet drill described in my earlier application, which produced such promising results in sandstone, did not produce the same benefits in Missouri Red Granite. For the present application, it has been found that the use of a single larger diameter reaming orifice, angled to drill the peripheral hole would remove the central core of rock to a sufficient degree that the nozzle would not interfere with it. This condition prevailed with the additional advantage of an improved advance rate. This latter design has been used in a series of tests to parameterize the performance of jet cutting granite and test results have been carried out to advance rates of the order of 40 inches per minute as shown in Table II.

TABLE II

Nozzle performance effects on drilling diameter in Missouri Red Granite. Pressure 15.5 ksi.

| Nozzle Angle | Advance Rate (in/min) 10 | 20 | 30 | 40 | Flow Rate (gpm) |
|---|---|---|---|---|---|
| | Hole Diameter (in.) | | | | |
| 10° | 1.1 | .76 | .65 | — | 9.16 |
| 15° | .78 | .70 | .68 | .57 | 9.09 |
| 20° | 1.25 | .65 | .60 | .60 | 8.82 |

The tap hole created by the single angled reaming jet appears to be sufficient to permit nozzle clearance and in combination with the radial jets directed at the point of contact between the roller cone teeth and the rock still produce the advantage of reduced load on the drill bit.

The combined structure of the water jet drill and roller cone bit, as described and claimed herein, produces a hole of uniform diameter with a minimum expenditure of energy. The use of a water jet alone would result in a hole of non-uniform diameter in rock structures of differing resistance to jet action. In addition, the water jet alone would require more energy than necessary since the ribs cut between adjacent slots are very weak and, therefore, easily removed by mechanical action. The tap hole created by the jet drill also serves to reduce somewhat the stresses in the rock in the immediate vicinity of the roller cone bit, thereby permitting a reduction in the thrust load on the bit.

It is to be understood that the embodiment shown and described is by way of example only and that many changes and modifications might be made thereto without departing from the spirit of the invention. The invention is not to be considered as limited to the embodiments shown and described, except in-so-far as the claims may be so limited.

I claim:

1. Rock drilling apparatus comprising:

a mechanical rock drilling tool in the form of an elongate cylindrical body having a longitudinal axis and a plurality of drilling teeth formed on rotatable cones and mounted on one end thereof;

a high pressure water jet nozzle mounted co-axially with said drilling tool body ahead of said drilling teeth and having orifices directed along said axis and at an angle with respect to said axis and adapted to drill a hole of relatively small diameter in rock in advance of a hole of relatively larger diameter formed by said drilling teeth;

said nozzle having a radial orifice for each of said rotatable cones and directed to cut rock immediately in advance of said drilling teeth; and means for rotating said drilling tool about its longitudinal axis for performing its drilling function.

* * * * *